US009593393B2

(12) United States Patent
Yoshida et al.

(10) Patent No.: US 9,593,393 B2
(45) Date of Patent: Mar. 14, 2017

(54) RAIL HEAT TREATMENT DEVICE AND RAIL HEAT TREATMENT METHOD

(75) Inventors: Yoshikazu Yoshida, Tokyo (JP); Hideki Takahashi, Tokyo (JP); Rinya Kojo, Tokyo (JP); Ryo Matsuoka, Tokyo (JP); Yuzuru Kataoka, Tokyo (JP); Tomoo Horita, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 311 days.

(21) Appl. No.: 14/375,232

(22) PCT Filed: Feb. 6, 2012

(86) PCT No.: PCT/JP2012/052582

§ 371 (c)(1),
(2), (4) Date: Jul. 29, 2014

(87) PCT Pub. No.: WO2013/118236

PCT Pub. Date: Aug. 15, 2013

(65) Prior Publication Data

US 2015/0021836 A1 Jan. 22, 2015

(51) Int. Cl.

| | |
|---|---|
| ***C21D 9/04*** | (2006.01) |
| ***C21D 11/00*** | (2006.01) |
| ***C21D 1/667*** | (2006.01) |

(52) U.S. Cl.

CPC ..... *C21D 9/04* (2013.01); *C21D 1/667* (2013.01); *C21D 11/00* (2013.01); *C21D 11/005* (2013.01); *C21D 2221/00* (2013.01)

(58) Field of Classification Search

CPC ..... C21D 11/005; C21D 9/04

USPC ..... 266/114

See application file for complete search history.

(56) References Cited

FOREIGN PATENT DOCUMENTS

| | | | | |
|---|---|---|---|---|
| GB | 550321 A | * | 1/1943 | ..... C21D 9/04 |
| JP | A-1-104721 | | 4/1989 | |
| JP | A-1-246323 | | 10/1989 | |
| JP | A-5-33057 | | 2/1993 | |
| JP | A-5-295444 | | 11/1993 | |
| JP | A-2003-193126 | | 7/2003 | |

OTHER PUBLICATIONS

International Search Report issued in International Application No. PCT/JP2012/052582 mailed on Apr. 17, 2012 (with translation).

(Continued)

*Primary Examiner* — Scott Kastler
(74) *Attorney, Agent, or Firm* — Oliff PLC

(57) ABSTRACT

A rail heat treatment device includes a cooling header, an oscillation mechanism, and a control system including: a storage unit that stores therein at least information required for a oscillation control; and a control unit that obtains a permissible range of required cooling time for a rail that satisfies a permissible range of hardness of the rail based on a correlation expression representing a correlation between the cooling time for the rail with the cooling header and the hardness of the rail after cooling, controls a stroke and a speed of relative reciprocation of the rail and the cooling header based on the permissible range of the required cooling time, and causes the oscillation mechanism to perform the relative reciprocation of the rail and the cooling header by the stroke and at the speed.

12 Claims, 8 Drawing Sheets

(56) References Cited

OTHER PUBLICATIONS

Written Opinion of the International Searching Authority issued in International Application No. PCT/JP2012/052582 mailed on Apr. 17, 2012 (with translation).

* cited by examiner

RAIL HEAT TREATMENT DEVICE AND RAIL HEAT TREATMENT METHOD

FIELD

The present invention relates to a rail heat treatment device that cools a rail and a rail heat treatment method.

BACKGROUND

Rail heat treatment devices have been developed that cool high-temperature rails after hot rolling. For example, a rail heat treatment device includes a device for supporting and restraining a base of a rail to be cooled, a cooling header for jetting a cooling medium to the rail supported and restrained by the supporting and restraining device, and an oscillation mechanism for oscillating (reciprocating) the supporting and restraining device or the cooling header in the longitudinal direction of the rail (refer to Patent Literatures 1 and 2).

In the rail heat treatment devices disclosed in Patent Literatures 1 and 2, a plurality of cooling headers for cooling an underside portion of the base of the rail are arranged under a rail supporting position. The cooling headers are arranged in a discontinuous state with predetermined intervals along the longitudinal direction of the rail. Such a gap portion (hereinafter, referred to as a discontinuous portion) between the cooling headers generates a rail portion to which the cooling medium from the cooling header is not sufficiently applied in the rail to be cooled. As a result, uneven cooling of the rail occurs along the longitudinal direction of the rail. To avoid such uneven cooling of the rail, the cooling header jets the cooling medium to the rail to be cooled while the oscillation mechanism relatively oscillates the rail and the cooling header along the longitudinal direction of the rail.

In addition to the heat treatment technique for rails disclosed in Patent Literatures 1 and 2, examples of a conventional cooling method using oscillation include a cooling method for steel materials that includes a plurality of cooling nozzles in a conveying direction of the steel materials arranged therein, and jets the cooling medium from the cooling nozzles while relatively oscillating the cooling nozzles and the steel materials in the horizontal direction (refer to Patent Literature 3). The oscillation control described in Patent Literature 3 prevents supercooling of the steel materials immediately under the cooling nozzle and insufficient cooling of the steel materials at the middle of the cooling nozzle.

CITATION LIST

Patent Literature

Patent Literature 1: Japanese Laid-open Patent Publication No. 5-33057

Patent Literature 2: Japanese Laid-open Patent Publication No. 5-295444

Patent Literature 3: Japanese Laid-open Patent Publication No. 2003-193126

SUMMARY

Technical Problem

However, Patent Literatures 1 to 3 merely disclose a technique for jetting the cooling medium to an object to be cooled (a rail or steel materials) from the cooling header while relatively oscillating the object to be cooled and the cooling header, and it is not considered how to perform oscillation control depending on the length of the discontinuous portion between the cooling headers. That is, according to the related art described above, it is difficult to set a speed and a length (stroke) of the oscillation appropriate for the length of the discontinuous portion between the cooling headers in controlling the relative oscillation of the rail to be cooled and the cooling header. Accordingly, proper oscillation control cannot be performed corresponding to intervals between the cooling headers, so that hardness unevenness of the rail is caused in the longitudinal direction of the rail and unevenness of the quality in the longitudinal direction of the rail cannot be prevented.

The present invention is made in view of such a situation, and provides a rail heat treatment device and a rail heat treatment method that can optimize the speed and the stroke of the relative oscillation of the rail and the cooling header corresponding to the length of the discontinuous portion between the cooling headers to prevent the hardness unevenness of the rail in the longitudinal direction of the rail and secure the uniform quality of the rail in the longitudinal direction of the rail.

Solution to Problem

To solve the above-described problem and achieve the object, a rail heat treatment device according to the present invention includes: a cooling header that jets a cooling medium to a rail to be cooled; an oscillation mechanism that relatively reciprocates the rail and the cooling header along a longitudinal direction of the rail; and a control system that performs oscillation control of the oscillation mechanism, the control system including: a storage unit that stores therein at least information required for the oscillation control; and a control unit that obtains a permissible range of required cooling time for the rail that satisfies a permissible range of hardness of the rail based on a correlation expression representing a correlation between the cooling time for the rail with the cooling header and the hardness of the rail after cooling, controls a stroke and a speed of relative reciprocation of the rail and the cooling header based on the permissible range of the required cooling time, and causes the oscillation mechanism to perform reciprocation by the stroke and at the speed.

Moreover, in the above-described rail heat treatment device according to the present invention, the cooling headers are provided in plurality and discontinuously arranged with predetermined intervals along the longitudinal direction of the rail, and the control system calculates a minimum value of the cooling time for the rail that is decreased due to a discontinuous portion between the cooling headers, and controls the stroke and the speed of the relative reciprocation of the rail and the cooling headers so that the minimum value of the cooling time falls within the permissible range of the required cooling time.

Moreover, in the above-described rail heat treatment device according to the present invention, the control system calculates a cooling time range of the rail that satisfies the permissible range of the hardness of the rail based on the correlation expression, and determines the required cooling time within the cooling time range.

Moreover, the above-described rail heat treatment device according to the present invention further includes: a cooling device including the cooling headers provided in plurality and arranged along the longitudinal direction of the rail; and a conveying device that carries the rail before cooling in the cooling device, and carries out the rail after cooling from a same side of the cooling device as a carrying-in side of the rail.

Moreover, the above-described rail heat treatment device according to the present invention further includes: a cooling device including the cooling headers provided in plurality and arranged along the longitudinal direction of the rail; a first conveying device that carries the rail before cooling in the cooling device; and a second conveying device that carries out the rail after cooling with the cooling device from an opposite side to a carrying-in side of the rail with the first conveying device.

Moreover, a rail heat treatment method according to the present invention includes: obtaining a permissible range of required cooling time for a rail to be cooled that satisfies a permissible range of hardness of the rail based on a correlation expression representing a correlation between the hardness of the rail after cooling and cooling time for cooling the rail by jetting a cooling medium to the rail from a cooling header; controlling a stroke and a speed of reciprocation based on the permissible range of the required cooling time; and performing reciprocation by the stroke and at the speed as relative reciprocation of the rail and the cooling header along the longitudinal direction of the rail.

Moreover, the above-described rail heat treatment method according to the present invention further includes: while taking into consideration a length of a discontinuous portion between cooling headers provided in plurality and discontinuously arranged with predetermined intervals along the longitudinal direction of the rail, calculating a minimum value of the cooling time for the rail that is decreased due to the discontinuous portion; and controlling a stroke and a speed of relative reciprocation of the rail and the cooling headers so that the minimum value of the cooling time falls within the permissible range of the required cooling time.

Moreover, the above-described rail heat treatment method according to the present invention further includes: calculating a cooling time range of the rail that satisfies the permissible range of the hardness of the rail based on the correlation expression; and determining the required cooling time within the cooling time range.

Moreover, the above-described rail heat treatment method according to the present invention further includes: carrying the rail before cooling in a cooling device including the cooling headers provided in plurality and arranged along the longitudinal direction of the rail; and carrying out the rail after cooling from a same side of the cooling device as a carrying-in side of the rail.

Moreover, the above-described rail heat treatment method according to the present invention further includes: carrying the rail before cooling in a cooling device including the cooling headers provided in plurality and arranged along the longitudinal direction of the rail; and carrying out the rail after cooling with the cooling device from a side of the cooling device opposite to a carrying-in side of the rail.

Advantageous Effects of Invention

According to the present invention, the speed and the stroke of the relative oscillation of the rail and the cooling header can be optimized corresponding to the length of the discontinuous portion between the cooling headers to prevent the hardness unevenness of the rail in the longitudinal direction of the rail and secure the uniform quality of the rail in the longitudinal direction of the rail.

DESCRIPTION OF EMBODIMENTS

The following describes an embodiment of a rail heat treatment device and a rail heat treatment method according to the present invention in detail with reference to drawings. The present invention is not limited to the embodiment.

Embodiment

Figure 1:
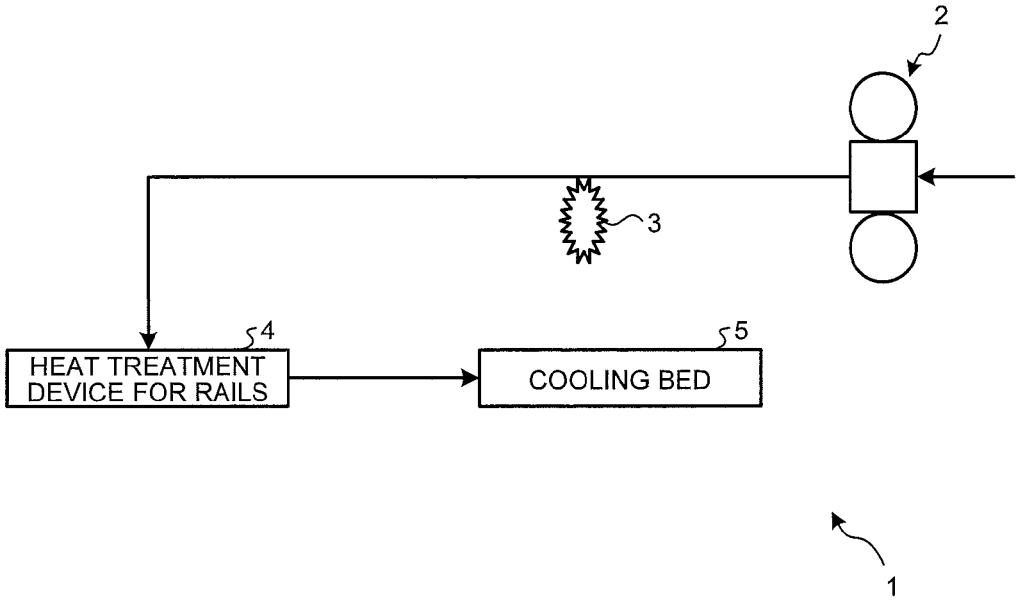
FIG. 1 is a block diagram illustrating a schematic configuration of a rail manufacturing line including a rail heat treatment device according to an embodiment of the present invention.
Figure 2:
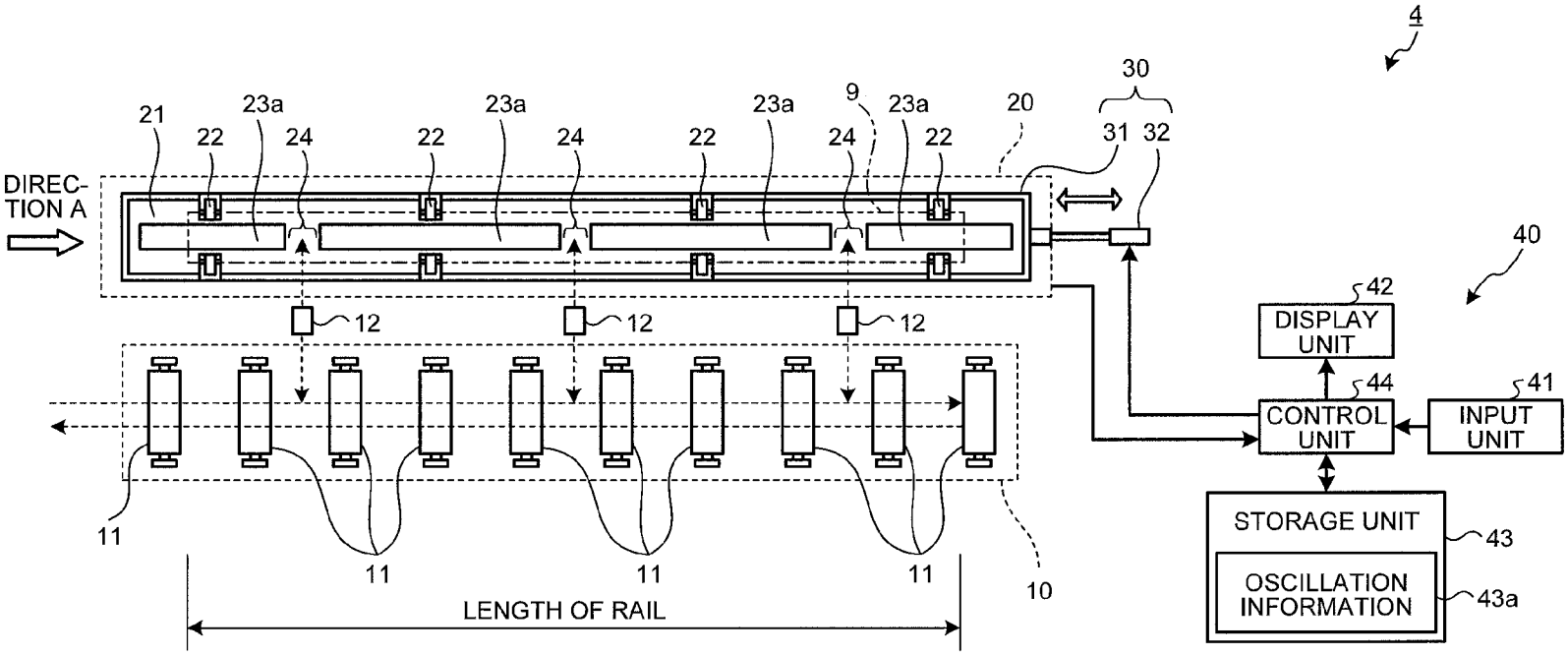
FIG. 2 is a schematic diagram illustrating a configuration example of the rail heat treatment device according to the embodiment of the present invention.
Figure 3:
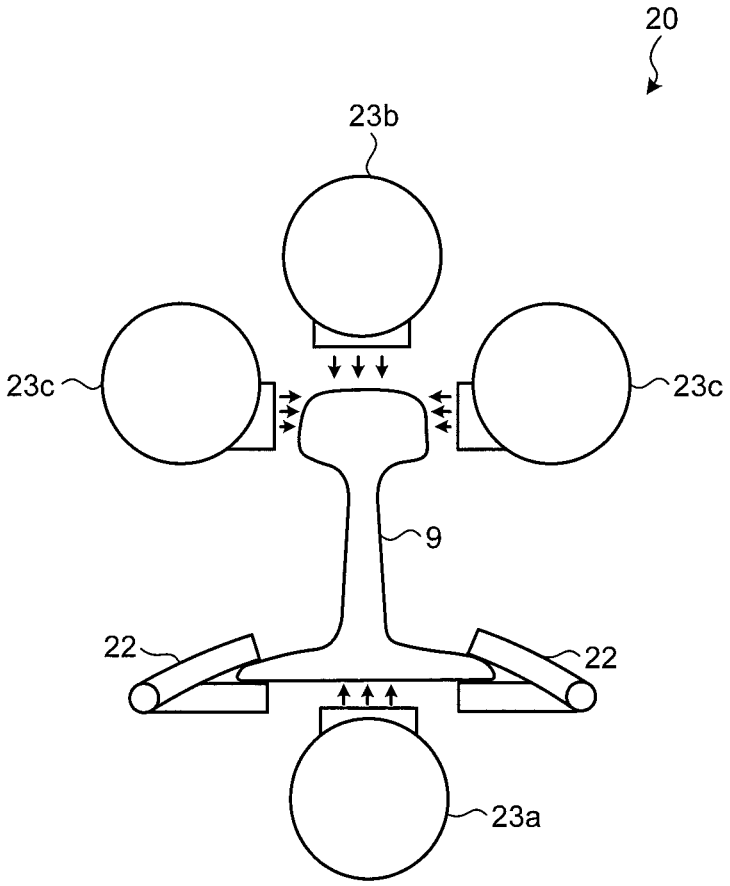
FIG. 3 is a schematic diagram illustrating a configuration example of cooling headers of the rail heat treatment device according to the embodiment.

FIG. 1 is a block diagram illustrating a schematic configuration of a rail manufacturing line including a rail heat treatment device according to an embodiment of the present invention. FIG. 2 is a schematic diagram illustrating a configuration example of the rail heat treatment device according to the embodiment of the present invention. FIG. 3 is a schematic diagram illustrating a configuration example of cooling headers of the rail heat treatment device according to the embodiment. Hereinafter, first, the configuration of the rail manufacturing line according to the embodiment will be described with reference to FIG. 1. Subsequently, the configuration of the rail heat treatment device according to the embodiment will be described with reference to FIGS. 2 and 3.

As illustrated in FIG. 1, a rail manufacturing line 1 according to the embodiment includes a finish rolling mill 2, a hot saw 3, a rail heat treatment device 4, and a cooling bed 5. The solid arrows in FIG. 1 indicate a flow of the rail in the rail manufacturing line 1.

The finish rolling mill 2 receives steel materials to be finish-rolled, and finish-rolls the received steel materials. Accordingly, the finish rolling mill 2 forms a rail having a cross-sectional shape in accordance with a requirement of a product order. The hot saw 3 cuts off crops at front and rear ends of the rail that is rolled with the finish rolling mill 2 to have the cross-sectional shape of the product, and cuts the rail into a length in accordance with the requirement of the product order.

The rail heat treatment device 4 receives the rail having the length made by the hot saw 3. The rail is a high-temperature member after hot finish rolling with the finish rolling mill 2. The rail heat treatment device 4 performs heat treatment for cooling the received high-temperature rail and carries out the cooled rail to the cooling bed 5 side. The rail heat treatment device 4 sequentially performs heat treatment (cooling processing) of each rail every time receiving the high-temperature rail from the hot saw 3 side as described above. The cooling bed 5 sequentially receives the rail cooled by the rail heat treatment device 4, and cools the rail from the rail heat treatment device 4 to a temperature close to the ambient temperature.

Next, the following describes the configuration of the rail heat treatment device 4 according to the embodiment. As illustrated in FIG. 2, the rail heat treatment device 4 is provided for cooling a high-temperature rail 9 after hot finish rolling as described above, and includes a conveying device 10 that conveys the rail 9, a cooling device 20 that cools the rail 9, an oscillation mechanism 30 that relatively reciprocates a cooling header 23*a* of the cooling device 20 and the rail 9, and a control system 40 that controls the oscillation mechanism 30.

The conveying device 10 is a device for receiving the rail 9 before cooling and for sending out the rail 9 after cooling, and includes a plurality of conveyance rollers 11 and a plurality of carrying-in/out parts 12. The conveyance rollers 11 are arranged in the vicinity of an entrance of the rail 9 at a lateral side of the cooling device 20 along the longitudinal direction of the rail 9 so that each conveyance roller shaft is perpendicular to the longitudinal direction of the rail 9. In this case, an arrangement length of the conveyance rollers 11 is longer than the length of one rail 9, as illustrated in FIG. 2. The conveyance rollers 11 are rotationally driven with a predetermined drive device (not illustrated), convey the rail 9 before cooling to the lateral side of the cooling device 20 as indicated by dashed-line arrows in FIG. 2, and send out the rail 9 after cooling to the outside.

The required number (for example, three) of carrying-in/out parts 12 are arranged in a region within the length of the rail 9 above the conveyance rollers 11 and at positions where they can each enter a clearance between the conveyance rollers 11. The carrying-in/out parts 12 are driven while adjusting operation timing, a moving direction, and a movement amount thereof to each other, and reciprocate between the positions of the conveyance rollers 11 and the positions in the cooling device 20 (refer to the dashed-line arrows in FIG. 2). Accordingly, the carrying-in/out parts 12 carry in the rail 9 before cooling to the cooling device 20 from the conveyance rollers 11, and carry out the rail 9 after cooling to the positions of the conveyances rollers 11 from the same side of the cooling device 20 as the carrying-in side of the rail 9. The required number of carrying-in/out parts 12 to be arranged is not limited to three, and may be any number so long as the rail 9 can be supported and transported.

The cooling device 20 is a device for cooling the high-temperature rail 9 after hot finish rolling. Specifically, as illustrated in FIGS. 2 and 3, the cooling device 20 includes a supporting and restraining device 21 that supports and restrains the rail 9 and cooling headers 23*a* to 23*c* that cool the rail 9. FIG. 3 illustrates a schematic configuration of the cooling device 20 viewed from the direction A in FIG. 2.

The supporting and restraining device 21 is made by using a support base and the like extending in the longitudinal direction of the rail 9, and supports the rail 9 conveyed with the carrying-in/out part 12 from the conveyance roller 11 side. In this case, the supporting and restraining device 21 supports the rail 9 so that the underside portion of the base of the rail 9 is opposed to the cooling header 23*a*. The supporting and restraining device 21 includes a plurality of restraining parts 22 with predetermined intervals in the region within the length of the rail 9. As illustrated in FIG. 2, the restraining parts 22 are arranged at predetermined positions (for example, at lateral positions of the cooling headers 23*a*) along the longitudinal direction of the rail 9. The restraining parts 22 clamp the base of the rail 9 as illustrated in FIG. 3, and cooperate with each other to restrain the rail 9 in a releasable manner.

The cooling headers 23*a* to 23*c* are made by using an injection nozzle and the like for cooling medium, jet the cooling medium to the rail 9 to be cooled, and cool the rail 9. Specifically, as illustrated in FIG. 3, the cooling header 23*a* jets the cooling medium to the underside portion of the base of the rail 9, so that the rail 9 is cooled from the side of the base thereof. As illustrated in FIG. 2, a plurality of such cooling headers 23*a* are discontinuously arranged with predetermined intervals along the longitudinal direction of the rail 9. That is, a discontinuous portion 24 is formed between the cooling headers 23*a*. The discontinuous portion 24 is a clearance required for the carrying-in/out part 12 to enter the cooling device 20, and is formed corresponding to each position of the carrying-in/out part 12.

On the other hand, as illustrated in FIG. 3, the cooling headers 23*b* and 23*c* jet the cooling medium to the side portion of the head of the rail 9, so that the rail 9 is cooled from the side portion of the head thereof. In detail, the cooling header 23*b* jets the cooling medium to a top portion of the head of the rail 9, and the cooling header 23*c* jets the cooling medium to a side portion of the head of the rail 9. Although not illustrated, the cooling headers 23*b* and 23*c* continuously extend along the longitudinal direction of the rail 9. Such cooling headers 23*b* and 23*c* are supported by a predetermined drive device (not illustrated), and move upward and downward when the carrying-in/out part 12 enters the cooling device 20, and when the carrying-in/out part 12 exits from the cooling device 20. Accordingly, the carrying-in/out part 12 or the rail 9 is prevented from being in contact with the cooling headers 23*b* and 23*c* at the time of carrying in or out the rail 9.

The oscillation mechanism 30 is provided for relatively reciprocating the rail 9 and the cooling headers 23*a* to 23*c* in the cooling device 20 along the longitudinal direction of the rail 9. Specifically, the oscillation mechanism 30 includes a supporting frame 31 fixed to the cooling device 20 and a cylinder device 32 that reciprocates the supporting frame 31 in the longitudinal direction of the rail 9.

The supporting frame 31 is a frame body that supports the supporting and restraining device 21 in the cooling device 20. As illustrated in FIG. 2, for example, the supporting frame 31 is fixed to the cooling device 20 so as to enclose the side of the supporting and restraining device 21. The cylinder device 32 includes an oscillation shaft that can reciprocate, and is connected to the supporting frame 31 via the oscillation shaft. The cylinder device 32 reciprocates the oscillation shaft so as to reciprocate the supporting and restraining device 21 in the longitudinal direction of the rail 9 together with the supporting frame 31.

The supporting and restraining device 21 is independent of the cooling headers 23*a* to 23*c* of the cooling device 20. That is, the supporting and restraining device 21 can be displaced relatively to the cooling headers 23*a* to 23*c*. The supporting and restraining device 21 restrains, as described above, the rail 9 with the restraining part 22. The cylinder device 32 reciprocates the supporting and restraining device 21 so as to reciprocate the rail 9 on the supporting and restraining device 21 relatively to the cooling headers 23*a* to 23*c* along the longitudinal direction of the rail 9. In this case, the cylinder device 32 reciprocates the rail 9 on the supporting and restraining device 21 relatively to, in particular, the cooling header 23*a* that is discontinuous along the longitudinal direction of the rail 9.

The control system 40 is provided for performing oscillation control of the oscillation mechanism 30. As illustrated in FIG. 2, the control system 40 includes an input unit 41 that inputs various pieces of information, a display unit 42 that displays various pieces of information, a storage unit 43 that stores therein information and the like required for the oscillation control, and a control unit 44 that performs oscillation control of the oscillation mechanism 30.

The input unit 41 is made by using an input device such as a keyboard and a mouse, and inputs various pieces of information to the control unit 44 in response to an input operation by an operator. Examples of input information from an input unit 41 include hardness information of the rail 9 after cooling, facility specification information of the rail heat treatment device 4 such as the length of the discontinuous portion 24 described above (that is, the interval between the cooling headers 23*a*), and material information such as the components and steel grade of the steel materials constituting the rail 9. A permissible range of the hardness of the rail 9 can also be input with the input unit 41.

The display unit 42 displays various pieces of information instructed by the control unit 44 to display. Specifically, the display unit 42 displays the input information from the input unit 41 and various pieces of information useful for the oscillation control such as an arithmetic processing result relating to the oscillation control.

The storage unit 43 stores therein information instructed by the control unit 44 to store, and transmits storage information instructed to be read to the control unit 44. Specifically, the storage unit 43 stores therein the input information from the input unit 41, operation information of the rail manufacturing line 1 illustrated in FIG. 1, and the like. The storage unit 43 also stores therein, as oscillation information 43*a*, a correlation expression representing a correlation between cooling time for the rail 9 with the cooling header 23*a* and the hardness of the rail 9 after cooling, an arithmetic expression for calculating the cooling time for the rail 9, the interval between the cooling headers 23*a*, and the like. In the present invention, a correlation table and the like may be used instead of the correlation expression described above as the information indicating the correlation between the cooling time for the rail 9 with the cooling header 23*a* and the hardness of the rail 9 after cooling, and a conversion table and the like may be used instead of the arithmetic expression described above as the information for calculating the cooling time for the rail 9. The storage unit 43 can also store therein the permissible range of the hardness of the rail 9 input from the input unit 41, and a permissible range of the cooling time for the rail 9 required for satisfying the permissible range of the hardness of the rail 9 (hereinafter, referred to as required cooling time) calculated based on the correlation expression representing the correlation among the permissible range of the hardness, the cooling time for the rail 9, and the hardness of the rail 9 after cooling.

The control unit 44 is made by using a memory for storing therein a computer program and the like for implementing a function of the rail heat treatment device 4 and a CPU and the like for executing the computer program in the memory. The control unit 44 controls each operation of the components of the control system 40, that is, the input unit 41, the display unit 42, and the storage unit 43. The control unit 44 also controls input/output of an electric signal to/from each of the components.

The control unit 44 also controls the oscillation mechanism 30 so as to relatively reciprocate the cooling header 23*a* and the rail 9 along the longitudinal direction of the rail 9 during a period in which the rail 9 in the cooling device 20 is cooled with the cooling medium from the cooling headers 23*a* to 23*c*. Specifically, the control unit 44 acquires, from the cooling device 20, cooling operation information indicating a state of cooling operation by the cooling device 20. Based on the acquired cooling operation information, the control unit 44 grasps timing when the rail 9 in the cooling device 20 is cooled with the cooling medium from the cooling headers 23*a* to 23*c*. The control unit 44 performs oscillation control of the oscillation mechanism 30 at the grasped timing when the rail 9 is cooled.

In the oscillation control, first, the control unit 44 acquires, from the oscillation information 43*a* in the storage unit 43, the correlation expression representing the correlation between the cooling time for the rail 9 with the cooling header 23*a* and the hardness of the rail 9 after cooling. Next, based on the acquired correlation expression, the control unit 44 obtains the permissible range of the cooling time for the rail 9 required for satisfying the permissible range of the hardness of the rail 9 (required cooling time). Subsequently, based on the permissible range of the required cooling time, the control unit 44 calculates proper values of a stroke (hereinafter, referred to as an oscillation stroke) and a speed (hereinafter, referred to as an oscillation speed) of relative reciprocation of the rail 9 and the cooling header 23*a* so that the cooling time for the rail 9 is within the permissible range of the required cooling time at every place regardless of a positional relation between the rail 9 and the cooling header 23*a* in the longitudinal direction. The control unit 44 performs oscillation control by causing the oscillation mechanism 30 to perform reciprocation by the calculated oscillation stroke and at the oscillation speed.

The correlation expression used for the oscillation control described above is expressed by the following expression (1), using hardness HV(h) of the rail 9 after cooling with the cooling medium from the cooling headers 23*a* to 23*c*, hardness HV(n) of the rail 9 after natural cooling without the cooling medium, cooling time t for the rail 9 with the cooling medium from the cooling headers 23*a* to 23*c*, and a constant K determined according to a type (components, shape, size, weight, and the like) of the rail 9.

$$HV(h)=K\times t+HV(n) \quad (1)$$

According to the expression (1), the cooling time t is decreased as opposing time or an opposing region of the rail 9 with respect to the discontinuous portion 24 between the cooling headers 23*a* is increased. This is because contact time of the rail 9 with the cooling medium from the cooling header 23*a* is decreased as the opposing time or the opposing region of the rail 9 is increased. The cooling time t for the rail 9 affected by the discontinuous portion 24 as described above changes depending on the oscillation stroke and the oscillation speed of the reciprocation of the rail 9 on the supporting and restraining device 21 caused by the oscillation mechanism 30.

Figure 4:
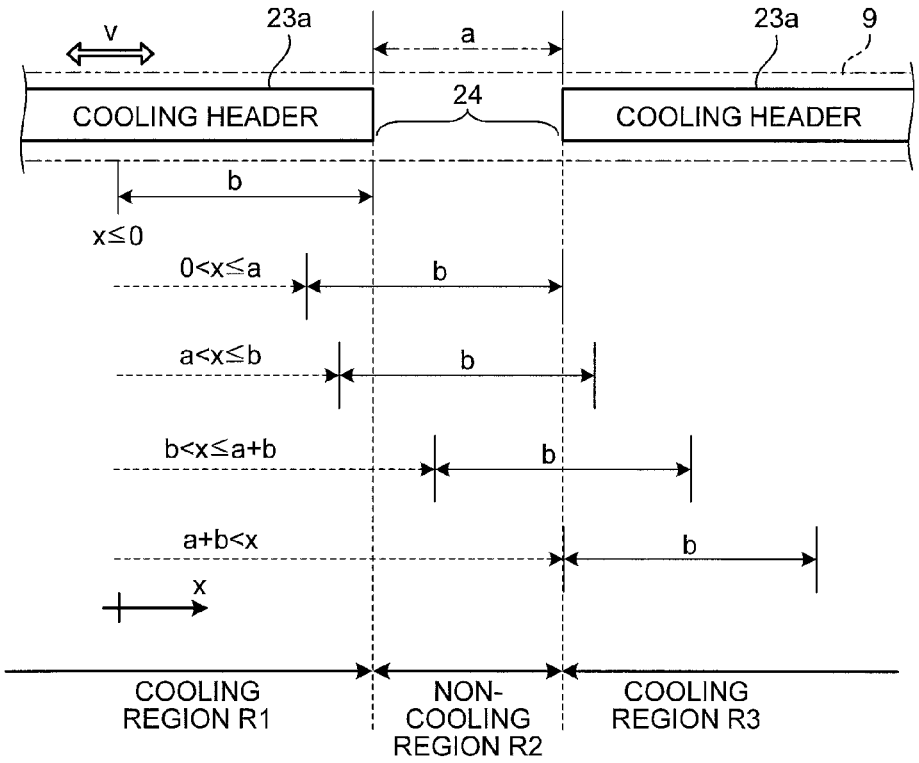
FIG. 4 is a diagram for explaining cooling time for a rail affected by a discontinuous portion between the cooling headers.

Next, the following describes the cooling time t for the rail 9 described above in detail. FIG. 4 is a diagram for explaining the cooling time for the rail affected by the discontinuous portion between the cooling headers. Hereinafter, one of the discontinuous portions 24 between the cooling headers 23*a* illustrated in FIG. 2 is exemplified to explain the cooling time t for the rail 9 affected by the discontinuous portion 24 in detail.

Because each of the regions where the rail 9 is opposed to the cooling header 23*a* is a region where the rail 9 is in contact with the cooling medium jetted from the cooling header 23*a* in FIG. 4, the regions are defined as cooling regions R1 and R3 of the rail 9. In contrast, because a region where the rail 9 is opposed to the discontinuous portion 24 is a region where the rail 9 is not opposed to the cooling medium from the cooling header 23*a*, the region is defined as a non-cooling region R2 of the rail 9. A portion of the rail 9 positioned at the non-cooling region R2 is not sufficiently cooled unlike portions of the rail 9 positioned at the cooling regions R1 and R3, but is nearly naturally cooled.

A coordinate axis parallel to the longitudinal direction of the rail 9 is set to all of the cooling regions R1 and R3, and the non-cooling region R2 defined in FIG. 4. The coordinate axis determines an oscillation end of the supporting and restraining device 21 oscillated by the oscillation mechanism 30, that is, a coordinate of a position x of an oscillation end of the rail 9 on the supporting and restraining device 21. The right direction of the coordinate axis, directed from the left cooling header 23*a* illustrated in FIG. 4 toward the right cooling header 23*a* through the discontinuous portion 24 is a positive direction, and the direction opposite thereto is a negative direction. As illustrated in FIG. 4, an origin of the coordinate axis is a position to which the end of the cooling header 23*a* on the discontinuous portion 24 side is displaced by an oscillation stroke b of the rail 9 in the negative direction of the coordinate axis.

As illustrated in FIG. 4, the rail 9 is partially opposed to the discontinuous portion 24 having the length equal to the interval a between the cooling headers 23*a*, and reciprocates by the oscillation stroke b and at an oscillation speed v along the longitudinal direction of the rail 9. The interval between the headers a is a facility specification of the cooling device 20 and is constant as long as the specification is not changed. The oscillation stroke b and the oscillation speed v are control factors of the oscillation control performed by the control unit 44 illustrated in FIG. 2. The oscillation stroke b is set to be larger than the interval between the headers a (b>a). Accordingly, when the rail 9 reciprocates, a portion of the rail 9 opposed to the discontinuous portion 24 necessarily has an opportunity to be opposed to the cooling header 23*a*.

To examine the cooling time for the rail 9 that reciprocates relatively to the cooling header 23*a*, a rail portion of the rail 9 having the oscillation end at the position x is noted, and the cooling time t for the noted rail portion for one reciprocation is examined.

When the position x is equal to or less than zero (x≤0), the cooling time t for the rail portion having the oscillation end at the position x is as follows. That is, in this case, the rail portion reciprocates along the longitudinal direction of the rail 9 within the cooling region R1 without entering the non-cooling region R2 as illustrated in FIG. 4. The cooling time t for the rail portion is calculated based on the following expression (2) using the oscillation stroke b and the oscillation speed v of the rail 9.

$$t=2b/v(x\leq 0) \tag{2}$$

Next, when the position x is positive and equal to or less than the interval between the headers a (0<x≤a), the cooling time t for the rail portion having the oscillation end at the position x is as follows. That is, in this case, the rail portion reciprocates along the longitudinal direction of the rail 9 across both of the cooling region R1 and the non-cooling region R2 as illustrated in FIG. 4. In this reciprocation, a period in which the rail portion enters the non-cooling region R2 and the length of the rail portion entering therein are both increased as compared with those in the case of x≤0 described above. The cooling time t for the rail portion depends on the oscillation stroke b and the oscillation speed v of the rail 9 and the position x of the oscillation end, and is calculated based on the following expression (3).

$$t=2b/v-2x/v(0<x\leq a) \tag{3}$$

Subsequently, when the position x exceeds the interval between the headers a and is equal to or less than the oscillation stroke b (a<x≤b), the cooling time t for the rail portion having the oscillation end at the position x is as follows. That is, in this case, the rail portion reciprocates along the longitudinal direction of the rail 9 across the cooling regions R1 and R3 and the non-cooling region R2 as illustrated in FIG. 4. In this reciprocation, a period in which the rail portion exists in the non-cooling region R2 and the length of the rail portion existing therein are both increased as compared with those in the case of 0<x≤a described above. The cooling time t for the rail portion depends on the oscillation stroke b and the oscillation speed v of the rail 9 and the interval between the headers a, and is calculated based on the following expression (4).

$$t=2b/v-2a/v(a<x\leq b) \tag{4}$$

Next, when the position x exceeds the oscillation stroke b and is equal to or less than the sum of the interval between the headers a and the oscillation stroke b (a+b) (b<x≤a+b), the cooling time t for the rail portion having the oscillation end at the position x is as follows. That is, in this case, the rail portion reciprocates along the longitudinal direction of the rail 9 across both of the non-cooling region R2 and the cooling region R3 as illustrated in FIG. 4. In this reciprocation, a period in which the rail portion exists in the non-cooling region R2 and the length of the rail portion existing therein are both decreased as compared with those in the case of a<x≤b described above. The cooling time t for the rail portion depends on the oscillation stroke b and the oscillation speed v of the rail 9, the interval between the headers a, and the position x of the oscillation end, and is calculated based on the following expression (5).

$$t=(2b/v-2a/v)+(2x-2b)/v=2x/v-2a/v(b<x\leq a+b) \tag{5}$$

Subsequently, when the position x exceeds the sum (a+b) described above (a+b<x), the cooling time t for the rail portion having the oscillation end at the position x is as follows. That is, in this case, the rail portion reciprocates along the longitudinal direction of the rail 9 within the cooling region R3 without entering the non-cooling region R2 as illustrated in FIG. 4. The cooling time t for the rail portion is then calculated based on the following expression (6) using the oscillation stroke b and the oscillation speed v of the rail 9 as in the case of x≤0 described above.

$$t=2b/v(a+b<x) \quad (6)$$

Figure 5:
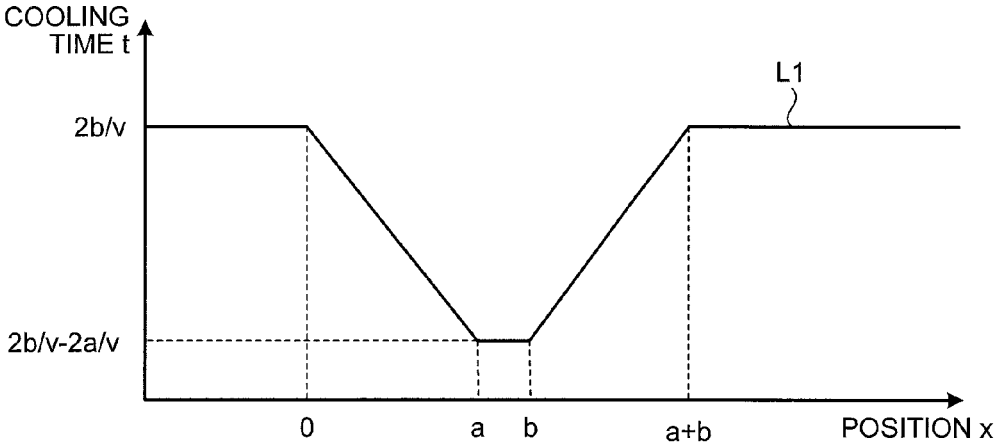
FIG. 5 is a schematic diagram illustrating a correlation between a position of an oscillation end and the cooling time for a rail portion.

As represented in the expressions (2) to (6) described above, the cooling time t for the rail portion having the oscillation end at the position x is increased or decreased corresponding to the change of the position x. FIG. 5 is a schematic diagram illustrating the correlation between the position of the oscillation end and the cooling time for the rail portion. As represented with a correlation line L1 in FIG. 5, the cooling time t described above is maintained at the maximum cooling time (=2b/v) when a coordinate value of the position x is equal to or less than zero. When the coordinate value of the position x is changed from zero to the interval between the headers a, the cooling time t is linearly decreased from the maximum cooling time to the minimum cooling time (=2b/v−2a/v). When the coordinate value of the position x is changed from the interval between the headers a to the oscillation stroke b, the cooling time t is maintained at the minimum cooling time. When the coordinate value of the position x is changed from the oscillation stroke b to the sum (a+b), the cooling time t is linearly increased from the minimum cooling time to the maximum cooling time (=2b/v) described above. When the coordinate value of the position x exceeds the sum (a+b), the cooling time t is maintained at the maximum cooling time.

As illustrated in FIG. 5, regarding the cooling time t that is increased or decreased corresponding to the change of the position x, the maximum cooling time Ts and the minimum cooling time Tm for the rail 9 with the cooling header 23*a* satisfy the following expression (7).

$$Ts:2b/v=Tm:(2b/v-2a/v) \quad (7)$$

Next, the following describes a rail heat treatment method according to the embodiment of the present invention. The following describes the rail heat treatment method according to the embodiment in detail exemplifying the rail 9 for one product with reference to FIGS. 1 to 3 described above.

As illustrated in FIG. 1, the rail 9 cut out with the hot saw 3 is conveyed to the rail heat treatment device 4. With the conveyance rollers 11 of the conveying device 10 illustrated in FIG. 2, the rail heat treatment device 4 carries in the rail 9 from the hot saw 3 to the vicinity of the lateral side of the cooling device 20.

The rail 9 on the conveyance rollers 11 is supported by the carrying-in/out parts 12 and taken out from the conveyance rollers 11. The carrying-in/out parts 12 transport the taken-out rail 9 toward the cooling device 20, and carry in the rail 9 from the lateral side (entrance side) of the cooling device 20 onto the supporting and restraining device 21.

The rail 9 carried in the cooling device 20 as described above is supported by the supporting and restraining device 21 and restrained with the restraining part 22. After that, the cooling headers 23*a* to 23*c* jet the cooling medium to the rail 9 on the supporting and restraining device 21. As the cooling medium, any cooling medium that can cool the rail 9 may be used. Examples thereof include air, spray water, gas-water mixture, steam, and water.

In this state, the control unit 44 of the control system 40 acquires the cooling operation information from the cooling device 20, and grasps cooling timing for the rail 9 based on the acquired cooling operation information. The control unit 44 controls the oscillation mechanism 30 at the cooling timing for the rail 9 to relatively reciprocate the cooling headers 23*a* to 23*c* and the rail 9 along the longitudinal direction of the rail 9.

In detail, the control unit 44 obtains the required cooling time for satisfying the permissible range of the hardness of the rail 9 required as a product based on the correlation expression represented as the expression (1) described above. In this case, the control unit 44 calculates, based on the correlation expression, a cooling time range for the rail 9 that satisfies the permissible range of the hardness of the rail 9. Subsequently, the control unit 44 determines the required cooling time for the rail 9 within the cooling time range.

Next, based on the required cooling time obtained as described above, the control unit 44 controls the oscillation stroke b and the oscillation speed v of the relative reciprocation of the rail 9 and the cooling header 23*a*. In this case, taking into consideration the length of the discontinuous portion 24 between the cooling headers 23*a*, that is, the interval between the headers a (refer to FIG. 4), the control unit 44 calculates the minimum value of the cooling time t for the rail 9 that is decreased due to the discontinuous portion 24 between the cooling headers 23*a*. Specifically, the control unit 44 calculates the minimum cooling time Tm for the rail 9 based on the expressions (2) to (7) described above. Subsequently, the control unit 44 controls the oscillation stroke b and the oscillation speed v so that the minimum cooling time Tm falls within the permissible range of the required cooling time for the rail 9. In this case, for example, the control unit 44 fixes the oscillation speed v at a proper value suitable for an operating condition of the rail manufacturing line 1 (refer to FIG. 1), and uses the oscillation stroke b as a parameter. Subsequently, the control unit 44 calculates the oscillation stroke b so that the minimum cooling time Tm described above falls within the permissible range of the required cooling time. The control unit 44 controls the cylinder device 32 of the oscillation mechanism 30 so as to perform reciprocation by the oscillation stroke b and at the oscillation speed v obtained as described above.

The cylinder device 32 reciprocates the oscillation shaft based on the control by the control unit 44 described above to reciprocate the supporting and restraining device 21 in the longitudinal direction of the rail 9 together with the supporting frame 31. As a result, the rail 9 on the supporting and restraining device 21 reciprocates along the longitudinal direction thereof by the oscillation stroke b and at the oscillation speed v relatively to the cooling headers 23*a* to 23*c*.

Such a rail 9 reciprocates by the oscillation stroke b and at the oscillation speed v determined by taking the discontinuous portion 24 into consideration as described above, and the cooling medium is jetted to the rail 9 from the cooling headers 23*a* to 23*c*. Due to a synergistic effect of the reciprocation and the jetting of the cooling medium, the rail 9 sufficiently makes contact with the cooling medium from the cooling headers 23*a* to 23*c* (specifically, the cooling medium from the cooling header 23*a* forming the discontinuous portion 24). The rail 9 is then uniformly cooled so as to have the hardness within the permissible range required as a product.

The control unit 44 grasps completion timing of jetting the cooling medium to the rail 9 based on the cooling operation information from the cooling device 20. The control unit 44 controls the cylinder device 32 at the grasped timing to stop the reciprocation of the rail 9 by the oscillation mechanism 30.

After that, the supporting and restraining device 21 releases the restrained state of the rail 9 by the restraining part 22 to free the rail 9 after cooling. Subsequently, after the carrying-in/out parts 12 enter the discontinuous portion 24 between the cooling headers 23*a*, the carrying-in/out parts 12 remove the rail 9 after cooling from the supporting and restraining device 21 and support the rail 9. Next, the carrying-in/out parts 12 carry out the rail 9 after cooling from the entrance side of the cooling device 20 described above, that is, the same side of the cooling device 20 as the carrying-in side of the rail 9 before cooling. The carrying-in/out parts 12 then transport the rail 9 after cooling toward the conveyance rollers 11 from the cooling device 20, and after that, place the rail 9 after cooling on the conveyance rollers 11. The conveyance rollers 11 carry out the rail 9 after cooling toward the cooling bed 5 (refer to FIG. 1) from the rail heat treatment device 4.

EXAMPLE

Figure 6:
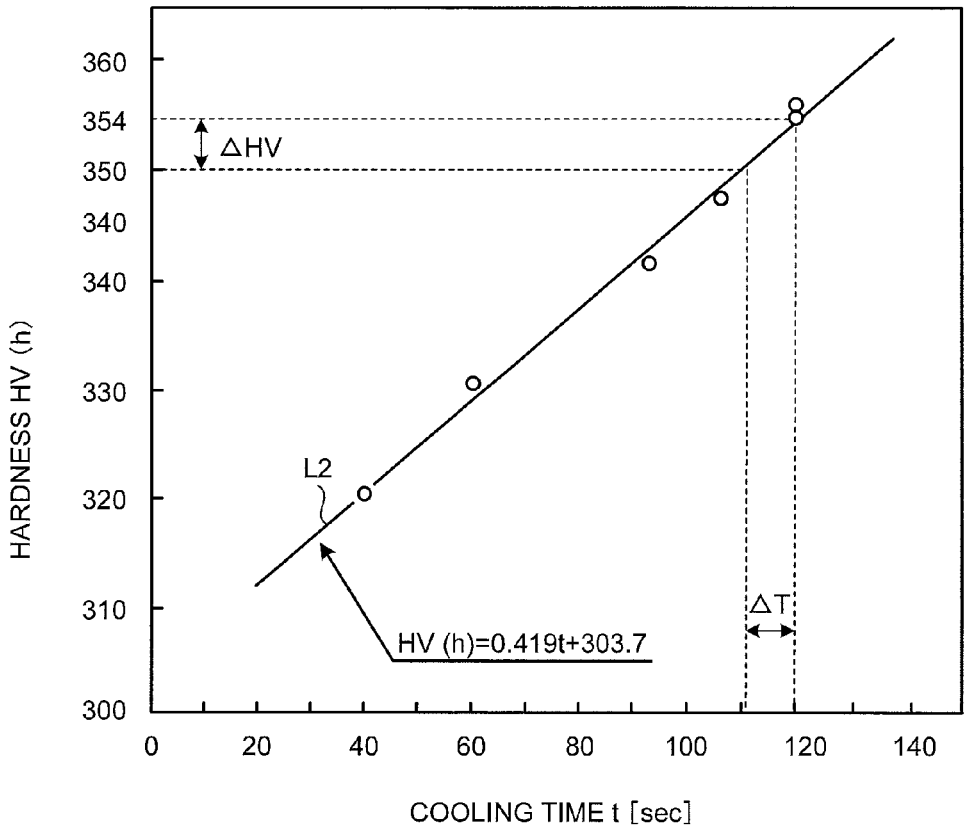
FIG. 6 is a schematic diagram illustrating a specific example of a correlation between the cooling time for the rail and the hardness of the rail after cooling.
Figure 7A:
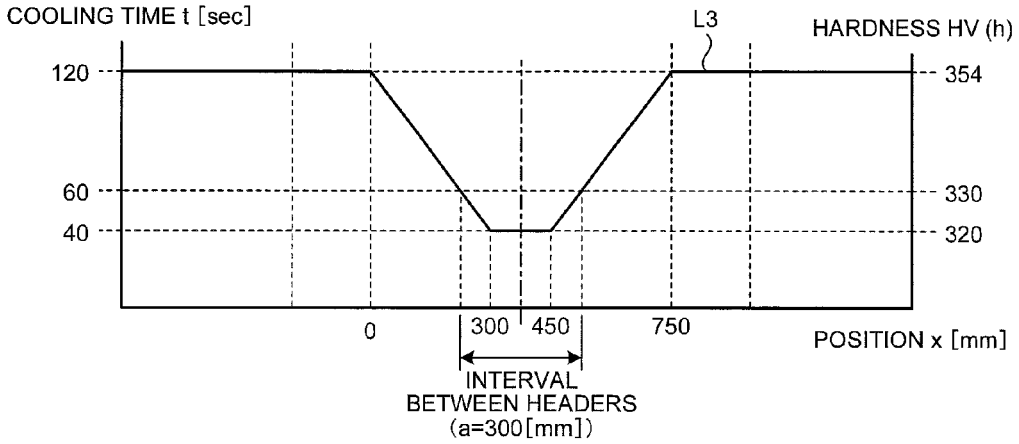
FIG. 7A is a schematic diagram illustrating a specific example of a correlation between the cooling time for the rail and the hardness thereof depending on an interval between the headers.
Figure 7B:
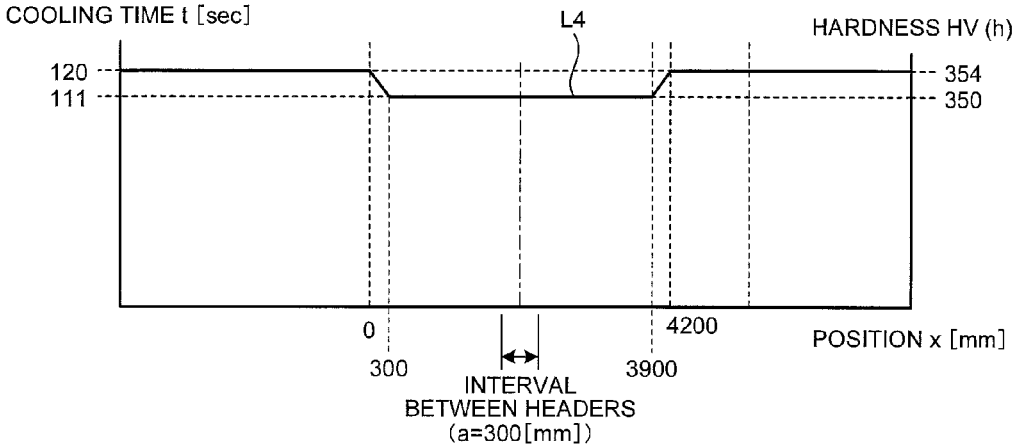
FIG. 7B is a schematic diagram illustrating a specific example of a correlation between the cooling time for the rail and the hardness thereof depending on the interval between the headers, and is an example of a case in which an oscillation stroke different from that in FIG. 7A is employed.
Figure 8A:
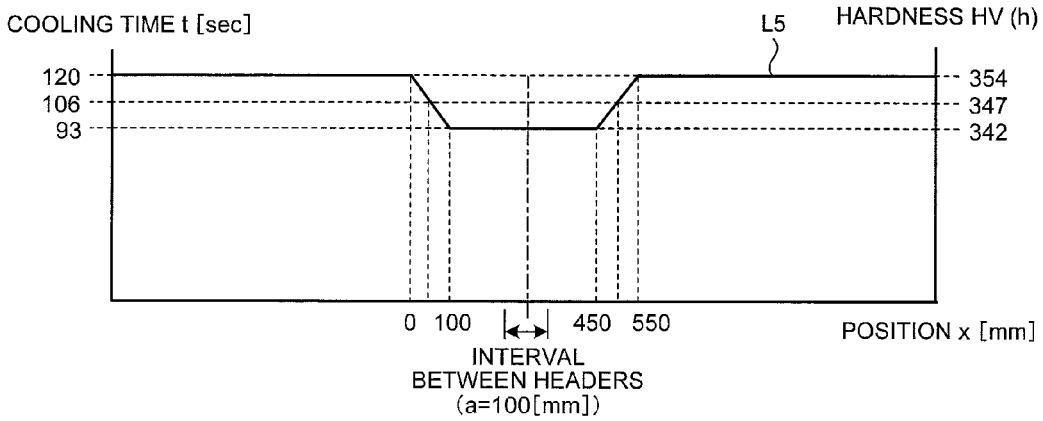
FIG. 8A is a schematic diagram illustrating another specific example of the correlation between the cooling time for the rail and the hardness thereof depending on the interval between the headers.
Figure 8B:
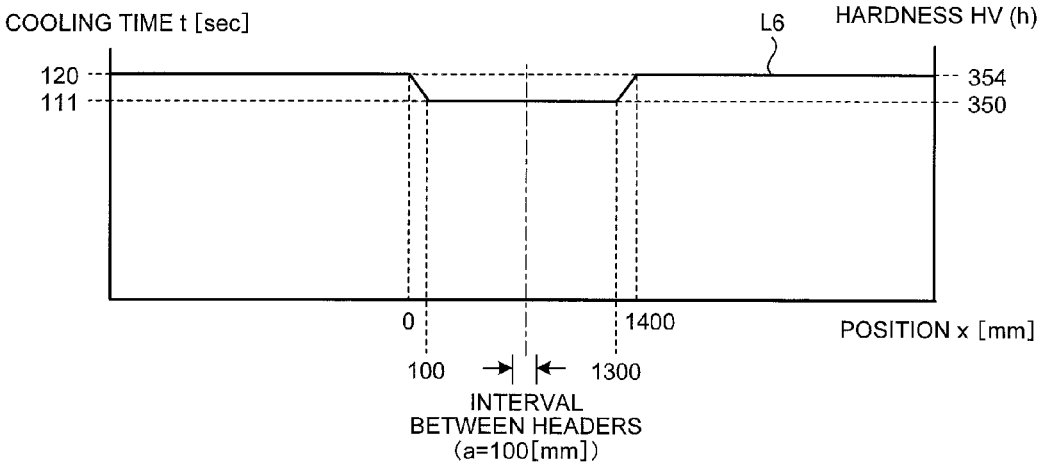
FIG. 8B is a schematic diagram illustrating another specific example of the correlation between the cooling time for the rail and the hardness thereof depending on the interval between the headers, and is an example of a case in which an oscillation stroke different from that in FIG. 8A is employed.

The following describes an example of the present invention by specifically exemplifying the interval a between the cooling headers 23*a*, the oscillation stroke b, and the oscillation speed v described above. FIG. 6 is a schematic diagram illustrating a specific example of the correlation between the cooling time for the rail and the hardness of the rail after cooling. FIGS. 7A and 7B are schematic diagrams illustrating a specific example of the correlation between the cooling time for the rail and the hardness thereof depending on the interval between the headers. FIGS. 8A and 8B are schematic diagrams illustrating another specific example of the correlation between the cooling time for the rail and the hardness thereof depending on the interval between the headers.

The present example uses, as the rail 9 to be cooled, an HH370 rail described in JIS E 1120 (2007). The hardness HV(h) of the rail 9 is a Vickers hardness at a position of 11 [mm] from a head top surface on a head-top center line of the rail 9.

When a relation between the hardness HV(h) and the cooling time t for the rail 9 were examined, it was found that the hardness HV(h) of the rail 9 changed depending on the cooling time t for the rail 9. That is, a correlation as illustrated in FIG. 6 was found between the hardness HV(h) and the cooling time t for the rail 9. Specifically, in FIG. 6, a correlation line L2 represents a specific example of the correlation between the cooling time t for the rail 9 and the hardness HV(h) of the rail 9 after cooling based on the expression (1) described above. In the expression of the correlation line L2, "0.419" corresponds to the constant K in the expression (1), and "303.7" corresponds to the hardness HV(n) in the expression (1).

Based on the correlation between the hardness HV(h) and the cooling time t, the relative reciprocation of the rail 9 and the cooling header 23*a* described above can be controlled. Specifically, first, a permissible range ΔHV of the hardness HV(h) of the rail 9 illustrated in FIG. 6 is set corresponding to a product requirement. Next, based on the correlation between the hardness HV(h) and the cooling time t represented by the correlation line L2, the permissible range ΔT of the required cooling time for the rail 9 that satisfies the permissible range ΔHV is calculated. Subsequently, the oscillation stroke b and the oscillation speed v are controlled so that the minimum cooling time Tm for the rail 9 falls within the permissible range ΔT of the required cooling time. The oscillation mechanism 30 is caused to perform reciprocation by the oscillation stroke b and at the oscillation speed v determined as described above. Accordingly, the rail 9 is uniformly cooled, so that the hardness HV(h) of the rail 9 after cooling is uniformized to hardness within the permissible range ΔHV illustrated in FIG. 6, that is, hardness within a required range.

Hereinafter, specific examples will be given. In the present example, the cooling time t for the rail portion not affected by the discontinuous portion 24 between the cooling headers 23*a*, that is, the maximum cooling time Ts of the rail 9 was set to 120 [sec] from the viewpoint of quality of the rail head. When the rail 9 is cooled for the maximum cooling time Ts=120 [sec], the hardness HV(h) of the rail 9 becomes 354, which is the maximum hardness.

Herein, considered is a case in which the permissible range ΔHV of the hardness HV(h) of the rail 9 is from 350 to 354. With reference to the correlation line L2 in FIG. 6, the cooling time t corresponding to the hardness HV(h)=350 is 111 [sec]. Accordingly, to cause the hardness HV(h) of the rail 9 to fall within the permissible range ΔHV, from 350 to 354, the cooling time t preferably falls within a range from 111 to 120 [sec]. That is, the permissible range ΔT of the required cooling time is from 111 to 120 [sec]. Accordingly, when the reciprocation of the rail 9 and the cooling headers 23*a* to 23*c* is controlled by determining the oscillation stroke b and the oscillation speed v so that the cooling time t falls within the range from 111 to 120 [sec], the hardness HV(h) of the rail 9 is controlled to be from 350 to 354, which is the permissible range ΔHV.

First, the correlation between the cooling time t for the rail 9 and the hardness HV(h) of the rail 9 was tested in a case in which the interval a between the cooling headers 23*a* was 300 [mm]. In this test, the oscillation speed v was set to 55 [mm/sec].

When the oscillation stroke b was set to 450 [mm], the minimum cooling time Tm [sec] for the rail 9, which was decreased due to influence of the interval between the headers a, was calculated as follows based on the expression (7) described above.

$$Tm=Ts/(2b/v)\times(2b/v-2a/v)=120/16.36\times5.45=40\ [\text{sec}]$$

A correlation between the position x of a stroke end and the cooling time t for the rail 9 is as represented by the correlation line L1 in FIG. 5. That is, when the coordinate value of the position x is equal to or less than zero, and when the coordinate value exceeds the sum (a+b), the cooling time t becomes the maximum. When the coordinate value of the position x exceeds the interval between the headers a and is equal to or less than the oscillation stroke b, the cooling time t becomes the minimum.

Accordingly, in the case of the interval between the headers a=300 [mm], the cooling time t for the rail 9 that satisfies maximum cooling time Ts=120 [sec] and the minimum cooling time Tm=40 [sec] was changed corresponding to the position x as represented by the correlation line L3 in FIG. 7A. Specifically, as illustrated in FIG. 7A, the cooling time t was maintained at 120 [sec] when the coordinate value of the position x was equal to or less than zero. When the coordinate value of the position x was changed from zero to the interval between the headers a=300 [mm], the cooling time t was linearly decreased from 120 [sec] to 40 [sec]. When the coordinate value of the position x was changed from the interval between the headers a=300 [mm] to the oscillation stroke b=450 [mm], the cooling time t was maintained at 40 [sec]. When the coordinate value of the position x was changed from the oscillation stroke b=450 [mm] to the sum (a+b)=750 [mm], the cooling time t was linearly increased from 40 [sec] to 120 [sec]. When the coordinate value of the position x exceeded the sum (a+b) =750 [mm], the cooling time t was maintained at 120 [mm]. As illustrated in FIG. 7A, the cooling time t was 60 [sec] when the position x is a discontinuous end of the cooling header 23*a*.

The hardness HV(h) of the rail 9 after cooling was tested corresponding to the cooling time t for the rail 9 correlated with the position x as described above. The hardness HV(h) represented by a right vertical axis in FIG. 7A was then obtained, and the correlation between the cooling time t and the hardness HV(h) was obtained as illustrated in FIG. 6.

However, under such a condition, that is, when the maximum cooling time Ts was 120 [sec], the interval between the headers a was 300 [mm], the oscillation speed v was 55 [mm/sec], and the oscillation stroke b was 450 [mm], the minimum cooling time Tm was 40 [sec], which did not fall within the permissible range ΔT (from 111 to 120 [sec]) of the required cooling time, and the hardness HV(h) that was actually obtained was from 320 to 354. The hardness HV(h) of the rail 9 did not fall within the permissible range ΔHV (from 350 to 354).

To cause the minimum cooling time Tm to be within the permissible range ΔT of the required cooling time (from 111 to 120 [sec]), influence of the oscillation stroke b on the minimum cooling time Tm was examined. As a result, it was found that the minimum cooling time Tm was 111 [sec] that was a lower limit value in the permissible range ΔT of the required cooling time if the oscillation stroke b was 3900 [mm]. The oscillation stroke b was then set to 3900 [mm] to test the correlation between the cooling time t for the rail 9 and the hardness HV(h) of the rail 9.

As represented by a correlation line L4 in FIG. 7B, the cooling time t for the rail 9 was changed corresponding to the position x. The hardness HV(h) of the rail 9 after cooling was tested corresponding to the cooling time t for the rail 9 correlated with the position x as described above. The hardness HV(h) represented by a right vertical axis in FIG. 7B was then obtained, and the correlation between the cooling time t and the hardness HV(h) was obtained as illustrated in FIG. 6.

Under such a condition, that is, when the maximum cooling time Ts was 120 [sec], the interval between the headers a was 300 [mm], the oscillation speed v was 55 [mm/sec], and the oscillation stroke b was 3900 [mm], the minimum cooling time Tm was 111 [sec], which fell within the permissible range ΔT (from 111 to 120 [sec]) of the required cooling time, and the hardness HV(h) that was actually obtained was from 350 to 354. The hardness HV(h) of the rail 9 fell within the permissible range ΔHV (from 350 to 354).

Next, as an example in which the interval a between the cooling headers 23*a* took another value, the correlation between the cooling time t for the rail 9 and the hardness HV(h) of the rail 9 was tested in a case in which the interval a between the cooling headers 23*a* was 100 [mm]. In this test, the oscillation speed v was set to 55 [mm/sec].

When the oscillation stroke b was 450 [mm], the minimum cooling time Tm [sec] of the rail 9, which was decreased due to influence of the interval between the headers a, was calculated as follows based on the expression (7) described above.

$$Tm=Ts/(2b/v)\times(2b/v-2a/v)=120/16.36\times12.73=93[\text{sec}]$$

That is, the minimum cooling time Tm was 93 [sec]. In this case, the cooling time t for the rail 9 was changed corresponding to the position x as represented by a correlation line L5 in FIG. 8A.

Specifically, as illustrated in FIG. 8A, the cooling time t was maintained at 120 [sec] when the coordinate value of the position x was equal to or less than zero. When the coordinate value of the position x was changed from zero to the interval between the headers a=100 [mm], the cooling time t was linearly decreased from 120 [sec] to 93 [sec]. When the coordinate value of the position x was changed from the interval between the headers a=100 [mm] to the oscillation stroke b=450 [mm], the cooling time t was maintained at 93 [sec]. When the coordinate value of the position x was changed from the oscillation stroke b=450 [mm] to the sum (a+b)=550 [mm], the cooling time t was linearly increased from 93 [sec] to 120 [sec]. When the coordinate value of the position x exceeded the sum (a+b)=550 [mm], the cooling time t was maintained at 120 [mm].

The hardness HV(h) of the rail 9 after cooling was tested corresponding to the cooling time t for the rail 9 correlated with the position x as described above. The hardness HV(h) represented by a right vertical axis in FIG. 8A was then obtained, and the correlation between the cooling time t and the hardness HV(h) was obtained as illustrated in FIG. 6. The method for testing the hardness herein is the same as that in the case of the interval between the headers a=300 [mm] described above.

However, under such a condition, that is, when the maximum cooling time Ts was 120 [sec], the interval between the headers a was 100 [mm], the oscillation speed v was 55 [mm/sec], and the oscillation stroke b was 450 [mm], the minimum cooling time Tm was 93 [sec], which did not fall within the permissible range ΔT (from 111 to 120 [sec]) of the required cooling time, and the hardness HV(h) that was actually obtained was from 342 to 354 as illustrated in FIG. 8A. The hardness HV(h) of the rail 9 did not fall within the permissible range ΔHV (from 350 to 354).

To cause the minimum cooling time Tm to be within the permissible range ΔT of the required cooling time (from 111 to 120 [sec]), influence of the oscillation stroke b on the minimum cooling time Tm was examined. As a result, it was found that the minimum cooling time Tm was 111 [sec] that was the lower limit value in the permissible range ΔT of the required cooling time if the oscillation stroke b was 1300 [mm]. The oscillation stroke b was then set to 1300 [mm] to test the correlation between the cooling time t for the rail 9 and the hardness HV(h) of the rail 9.

As represented by a correlation line L6 in FIG. 8B, the cooling time t for the rail 9 was changed corresponding to the position x. The hardness HV(h) of the rail 9 after cooling was tested corresponding to the cooling time t for the rail 9 correlated with the position x as described above. The hardness HV(h) represented by a right vertical axis in FIG. 8B was then obtained, and the correlation between the cooling time t and the hardness HV(h) was obtained as illustrated in FIG. 6.

Under such a condition, that is, when the maximum cooling time Ts was 120 [sec], the interval between the headers a was 100 [mm], the oscillation speed v was 55 [mm/sec], and the oscillation stroke b was 1300 [mm], the minimum cooling time Tm was 111 [sec], which fell within the permissible range ΔT (from 111 to 120 [sec]) of the required cooling time, and the hardness HV(h) that was actually obtained was from 350 to 354. The hardness HV(h) of the rail 9 fell within the permissible range ΔHV (from 350 to 354).

Although the present example uses, as the rail 9 to be cooled, the HH370 rail described in JIS E 1120 (2007), the present invention exhibits the same advantageous effect as that in the example described above with a rail of any other steel grade. That is, the rail 9 to be cooled of any steel grade is used in the present invention.

As described above, in the embodiment of the present invention, the cooling time required for satisfying the permissible range of the hardness of the rail (required cooling time for the rail) is obtained based on the correlation expression representing the correlation between the hardness of the rail after cooling and the cooling time for the rail with the cooling medium from the cooling headers arranged along the longitudinal direction of the rail. In addition, the oscillation stroke and the oscillation speed are controlled based on the required cooling time to perform the reciprocation by the controlled oscillation stroke and at the controlled oscillation speed as the relative reciprocation of the rail and the cooling header along the longitudinal direction of the rail.

Accordingly, even when the cooling headers for cooling the rail to be cooled are discontinuously arranged along the longitudinal direction of the rail, it is possible to set proper values of the oscillation stroke and the oscillation speed suitable for the length of the discontinuous portion, corresponding to the length of the discontinuous portion between the cooling headers. As the relative reciprocation of the rail and the cooling headers, the reciprocation can be performed by a proper oscillation stroke and at a proper oscillation speed while taking into consideration the length of the discontinuous portion. That is, a proper oscillation control can be performed while taking into consideration the interval between the cooling headers. Accordingly, even when the rail is cooled using the cooling headers discontinuously arranged in the longitudinal direction of the rail, a difference in the cooling time for the rail can be reduced across the longitudinal direction of the rail. As a result, because uneven cooling of the rail in the longitudinal direction thereof can be eliminated, it is possible to prevent hardness unevenness of the rail in the longitudinal direction of the rail and to secure uniform quality of the rail in the longitudinal direction of the rail.

In the embodiment described above, as illustrated in FIG. 2, the rail entrance side of the cooling device 20 for carrying the rail 9 before cooling in the cooling device 20 is the same as the rail exit side of the cooling device 20 for carrying out the rail 9 after cooling from the cooling device 20. However, the embodiment is not limited thereto. The rail entrance side and the rail exit side of the cooling device 20 may be different from each other.

Figure 9:
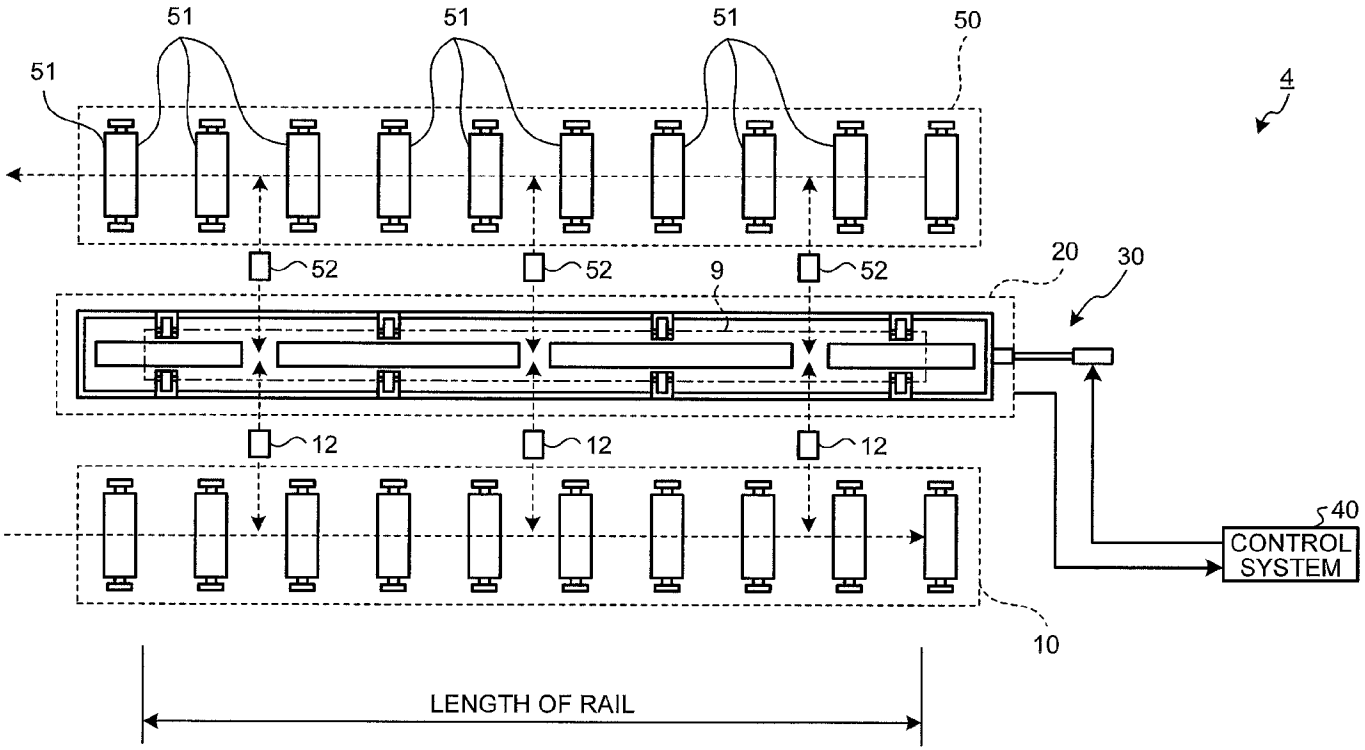
FIG. 9 is a schematic diagram illustrating a modification of the rail heat treatment device according to the embodiment of the present invention.

Specifically, as illustrated in FIG. 9, a conveying device 50 for carrying-out may be arranged on the opposite side to the conveying device 10 across the cooling device 20, the conveying device 50 having substantially the same configuration as that of the conveying device 10. That is, the conveying device 10 serving as a first conveying device may carry the rail 9 before cooling in the cooling device 20, and the conveying device 50 serving as a second conveying device may carry out the rail 9 after cooling from the cooling device 20. In this case, using a carrying-out part 52 that reciprocates between a conveyance roller 51 and the discontinuous portion 24 between the cooling headers 23*a* (refer to FIG. 2), the conveying device 50 may carry out the rail 9 after cooling from the side of the cooling device 20 opposite to the rail carrying-in side (hereinafter, referred to as an exit side). As represented by the dashed-line arrows in FIG. 9, the conveying device 10 is a device for carrying the rail 9 in the cooling device 20, and the carrying-in/out part 12 described above does not necessarily carry out the rail 9 from the cooling device 20. In addition, at the same time when the conveying device 10 carries in the rail, the conveying device 50 may carry out the rail 9 after cooling from the exit side of the cooling device 20 using the carrying-out parts 52 and the conveyance rollers 51.

In the embodiment described above, a position of the cooling header is fixed, and the rail is reciprocated relatively to the cooling header along the longitudinal direction of the rail. However, the embodiment is not limited thereto. In the oscillation control according to the present invention, a position of the rail may be fixed in the cooling device, and the cooling header may be reciprocated relatively to the rail along the longitudinal direction of the rail. That is, the rail to be cooled and the cooling header may be relatively reciprocated along the longitudinal direction of the rail.

In the example described above, the hardness at the position of 11 [mm] from the head top surface was measured on the head-top center line of the rail 9 after cooling. However, the example is not limited thereto. For example, in addition to the hardness of a gauge corner part, the hardness of any portion among the side of the head, the web, and the base of the rail 9 after cooling may be measured. That is, the advantageous effect according to the present invention is applicable to all the portions of the rail 9, not limited to the top portion of the head of the rail 9 after cooling.

In the embodiment described above, the cooling headers 23*b* and 23*c* for cooling the side of the head of the rail 9 are continuously arranged along the longitudinal direction of the rail 9. However, the embodiment is not limited thereto. The cooling headers 23*b* and 23*c* may be, similarly to the cooling header 23*a* described above, discontinuously arranged along the longitudinal direction of the rail 9.

The present invention is not limited to the embodiment described above. The present invention also encompasses a configuration in which the components described above are appropriately combined. In addition, the present invention encompasses all of other embodiments, examples, operation technique, and the like made by those skilled in the art based on the embodiment described above.

INDUSTRIAL APPLICABILITY

As described above, the rail heat treatment device and the rail heat treatment method according to the present invention are useful for the heat treatment that cools the rail, and specifically, suitable for the rail heat treatment device and the rail heat treatment method for uniformly cooling the rail in the longitudinal direction thereof using the cooling headers that are discontinuously arranged along the longitudinal direction of the rail.

REFERENCE SIGNS LIST

1 Rail manufacturing line
2 Finish rolling mill
3 Hot saw
4 Rail heat treatment device
5 Cooling bed
9 Rail
10, 50 Conveying device
11, 51 Conveyance roller
12 Carrying-in/out part
20 Cooling device
21 Supporting and restraining device
22 Restraining part

23*a* to 23*c* Cooling header
24 Discontinuous portion
30 Oscillation mechanism
31 Supporting frame
32 Cylinder device
40 Control system
41 Input unit
42 Display unit
43 Storage unit
43*a* Oscillation information
44 Control unit
52 Carrying-out part
L1 to L6 Correlation line
R1, R3 Cooling region
R2 Non-cooling region

The invention claimed is:

1. A rail heat treatment device comprising:

a cooling header that jets a cooling medium to a rail to be cooled;

an oscillation mechanism that relatively reciprocates the rail and the cooling header along a longitudinal direction of the rail; and a control system that performs oscillation control of the oscillation mechanism, the control system comprising:

a storage unit that stores therein at least information required for the oscillation control; and a control unit that obtains a permissible range of required cooling time for the rail that satisfies a permissible range of hardness of the rail based on a correlation expression representing a correlation between the cooling time for the rail with the cooling header and the hardness of the rail after cooling, determines the required cooling time within the obtained permissible range of required cooling time, controls a stroke and a speed of relative reciprocation of the rail and the cooling header based on the determined required cooling time, and causes the oscillation mechanism to perform reciprocation by the stroke and at the speed, wherein the correlation expression is expressed by the following expression (1):

$$HV(h)=K\times t+HV(n) \quad (1),$$

where:

HV(h): hardness of the rail after cooling with the cooling medium from the cooling headers, HV(n): hardness of the rail after natural cooling without the cooling medium, t: cooling time for the rail with the cooling medium from the cooling headers, and K: a constant determined according to a type of the rail.

2. The rail heat treatment device according to claim 1, wherein the cooling headers are provided in plurality and discontinuously arranged with predetermined intervals along the longitudinal direction of the rail, and the control system calculates a minimum value of the cooling time for the rail that is decreased due to a discontinuous portion between the cooling headers, and controls the stroke and the speed of the relative reciprocation of the rail and the cooling headers so that the minimum value of the cooling time falls within the permissible range of the required cooling time.

3. The rail heat treatment device according to claim 1, further comprising:

a cooling device including the cooling headers provided in plurality and arranged along the longitudinal direction of the rail; and a conveying device that carries the rail before cooling in the cooling device, and carries out the rail after cooling from a same side of the cooling device as a carrying-in side of the rail.

4. The rail heat treatment device according to claim 1, further comprising:

a cooling device including the cooling headers provided in plurality and arranged along the longitudinal direction of the rail;

a first conveying device that carries the rail before cooling in the cooling device; and a second conveying device that carries out the rail after cooling with the cooling device from an opposite side to a carrying-in side of the rail with the first conveying device.

5. A rail heat treatment method comprising:

obtaining a permissible range of required cooling time for a rail to be cooled that satisfies a permissible range of hardness of the rail based on a correlation expression representing a correlation between the hardness of the rail after cooling and cooling time for cooling the rail by jetting a cooling medium to the rail from a cooling header;

determining the required cooling time within the obtained permissible range of required cooling time;

controlling a stroke and a speed of reciprocation based on the determined required cooling time; and performing reciprocation by the stroke and at the speed as relative reciprocation of the rail and the cooling header along the longitudinal direction of the rail, wherein the correlation expression is expressed by the following expression (1):

$$HV(h)=K\times t+HV(n) \quad (1),$$

where:

HV(h): hardness of the rail after cooling with the cooling medium from the cooling headers, HV(n): hardness of the rail after natural cooling without the cooling medium, t: cooling time for the rail with the cooling medium from the cooling headers, and K: a constant determined according to a type of the rail.

6. The rail heat treatment method according to claim 5, further comprising:

while taking into consideration a length of a discontinuous portion between cooling headers provided in plurality and discontinuously arranged with predetermined intervals along the longitudinal direction of the rail, calculating a minimum value of the cooling time for the rail that is decreased due to the discontinuous portion; and controlling a stroke and a speed of relative reciprocation of the rail and the cooling headers so that the minimum value of the cooling time falls within the permissible range of the required cooling time.

7. The rail heat treatment method according to claim 5, further comprising:

carrying the rail before cooling in a cooling device including the cooling headers provided in plurality and arranged along the longitudinal direction of the rail; and carrying out the rail after cooling from a same side of the cooling device as a carrying-in side of the rail.

8. The rail heat treatment method according to claim 5, further comprising:

carrying the rail before cooling in a cooling device including the cooling headers provided in plurality and arranged along the longitudinal direction of the rail; and carrying out the rail after cooling with the cooling device from a side of the cooling device opposite to a carrying-in side of the rail.

9. The rail heat treatment device according to claim 2, further comprising:

a cooling device including the cooling headers provided in plurality and arranged along the longitudinal direction of the rail; and a conveying device that carries the rail before cooling in the cooling device, and carries out the rail after cooling from a same side of the cooling device as a carrying-in side of the rail.

10. The rail heat treatment device according to claim 2, further comprising:

a cooling device including the cooling headers provided in plurality and arranged along the longitudinal direction of the rail;

a first conveying device that carries the rail before cooling in the cooling device; and a second conveying device that carries out the rail after cooling with the cooling device from an opposite side to a carrying-in side of the rail with the first conveying device.

11. The rail heat treatment method according to claim 6, further comprising:

carrying the rail before cooling in a cooling device including the cooling headers provided in plurality and arranged along the longitudinal direction of the rail; and carrying out the rail after cooling from a same side of the cooling device as a carrying-in side of the rail.

12. The rail heat treatment method according to claim 6, further comprising:

carrying the rail before cooling in a cooling device including the cooling headers provided in plurality and arranged along the longitudinal direction of the rail; and carrying out the rail after cooling with the cooling device from a side of the cooling device opposite to a carrying-in side of the rail.

* * * * *